US006383992B1

(12) United States Patent
Garmier et al.

(10) Patent No.: US 6,383,992 B1
(45) Date of Patent: May 7, 2002

(54) BIODEGRADABLE VEGETABLE OIL COMPOSITIONS

(75) Inventors: William W Garmier; Adam W Rotondo, both of Hartville, OH (US)

(73) Assignee: Renewable Lubricants, Inc., Hartville, OH (US)

( * ) Notice: Subject to any disclaimer, the term of this patent is extended or adjusted under 35 U.S.C. 154(b) by 0 days.

(21) Appl. No.: 09/605,324

(22) Filed: Jun. 28, 2000

(51) Int. Cl.[7] ..... C10M 161/00
(52) U.S. Cl. ..... 508/491; 508/563; 508/591
(58) Field of Search ..... 508/491, 563, 508/591, 473

(56) References Cited

U.S. PATENT DOCUMENTS

| | | | | | |
|---|---|---|---|---|---|
| 4,783,274 | A | | 11/1988 | Jokinen et al. | |
| 5,298,177 | A | | 3/1994 | Stoffa | |
| 5,338,471 | A | | 8/1994 | Lal | |
| 5,399,275 | A | | 3/1995 | Lange et al. | |
| 5,413,725 | A | | 5/1995 | Lal et al. | |
| 5,538,654 | A | | 7/1996 | Lawate et al. | |
| 5,641,734 | A | | 6/1997 | Naegely | |
| 5,773,391 | A | * | 6/1998 | Lawate et al. | 508/491 |
| 5,916,854 | A | * | 6/1999 | Inaya et al. | 508/491 |
| 5,990,055 | A | * | 11/1999 | Garmier | 508/491 |

* cited by examiner

*Primary Examiner*—Jacqueline V. Howard
(74) *Attorney, Agent, or Firm*—James L. Cordek

(57) ABSTRACT

A composition, comprising; (A) at least one triglyceride oil of the formula

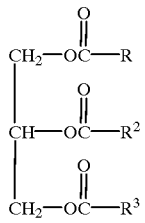

wherein $R^1$, $R^2$ and $R^3$ are aliphatic hydrocarbyl groups containing from about 7 to about 23 carbon atoms; (B) a pour point depressant comprising (1) an alkylated polystyrene or (2) a polyalkyl methacrylate; and (C) an antioxidant comprising an amine of the formula

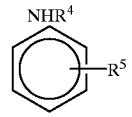

wherein $R^4$ is

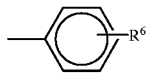

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group. Optionally, the (A), (B) and (C) composition may further comprise (D) other oils.

19 Claims, No Drawings

BIODEGRADABLE VEGETABLE OIL COMPOSITIONS

FIELD OF THE INVENTION

This invention relates to biodegradable lubricant compositions made from vegetable oil triglycerides and also pour point depressants and amine antioxidants. These lubricant compositions can be used for lubricating engines, transmissions, gear boxes, and for hydraulic applications. These compositions provide antioxidant stability as well as cold temperature performance. These compositions can also be used as a base stock for biodegradable greases or any other biodegradable lubricant compositions requiring oxidation stability and cold temperature stability, such as a penetrating composition and a metal working composition.

BACKGROUND OF THE INVENTION

Vegetable oils are obtainable in large volumes from renewable resources and in general are characterized as readily biodegradable or "environmentally friendly." As a result, such oils are potentially attractive for use in a wide variety of applications.

With respect to use for lubrication purposes, vegetable oils have not been fully desirable. Many vegetable oils do not possess the desired spectrum of characteristics relating to: pour point; oxidative stability; and compatibility with additives among others. Vegetable oils do however possess many desirable properties for use as a lubricant. In particular, vegetable oils typically provide good boundary lubrication, good viscosity, high viscosity index and high flash point. In addition, vegetable oils are generally nontoxic and readily biodegradable. For example, under standard test conditions (e.g., OCED 301D test method), a typical vegetable oil can biodegrade up to 80% into carbon dioxide and water in 28 days, as compared to 25% or less for typical petroleum-based lubricating fluids.

U. S. Pat. No. 4,783,274 (Jokinen et al., Nov. 8, 1988) is concerned with an anhydrous oily lubricant, which; is based on vegetable oils, which is substituted for mineral lubricant oils, and which, as its main component, contains triglycerides that are esters of saturated and/or unsaturated straight-chained $C_{10}$ to $C_{22}$ fatty acids and glycerol. The lubricant is characterized in that it contains at least 70 percent by weight of a triglyceride whose iodine number is at least 50 and no more than 125 and whose viscosity index is at least 190. As its basic component, instead of or along with the said triglyceride, the lubricant oil may also contain a polymer prepared by hot-polymerization out of the said triglyceride or out of a corresponding triglyceride. As additives, the lubricant oil may contain solvents, fatty acid derivatives, in particular their metal salts, organic or inorganic, natural or synthetic polymers, and customary additives for lubricants.

U. S. Patent No. 5,298,177 (Stoffa Mar. 29, 1994) discloses a functional fluid comprising (A) at least one triglyceride;

(B) at least one detergent-inhibitor additive; and (C) at least one viscosity modifying additive and further comprising (D) at least one synthetic oil.

U. S. Patent No. 5,388,471 (Lal, Aug. 16, 1994) relates to vegetable oils that possess at least 60 percent monounsaturation content, vegetable oils that are transesterified and contain at least one pour point depressant. In addition to pour point depressants, the vegetable oil and transesterified product also contain a performance additive designed to enhance the performance of the vegetable oil and transesterified product when used in hydraulic fluids, two-cycle (two stroke) internal combustion engines, gear oils and passenger car motor oils.

U.S. Pat. No. 5,399,275 (Lange et al., Mar. 21, 1995) relates to triglyceride oils having viscosity index improving characteristics wherein the triglyceride oils contain at least a 60 percent monounsaturated content. Triglyceride oils containing this viscosity index improver have utility in passenger car motor oils (PCMO), gear oils, automatic transmissions fluids (ATF), hydraulic fluids, chain bar lubricants, way lubricants for machinery operations, diesel lubricants and tractor fluids.

U.S. Pat. No. 5,413,725 (Lal et al., May 9, 1995) is directed to vegetable oils that possess at least 60 percent monounsaturation content and contain at least one pour point depressant. In addition to pour point depressants, the vegetable oil may also contain a performance additive designed to enhance the performance of the vegetable oil when used in hydraulic fluids, two cycle (two stroke) internal combustion engines, gear oils, and passenger car motor oils. U.S. Pat. No. 5,538,654 (Lawate et al., Jul. 23, 1996) describes a food grade lubricant composition which is useful as hydraulic oil, gear oil, and compressor oil for equipment in the food service industry. This composition comprises (A) a major amount of a genetically modified vegetable oil and (B) a minor amount of a performance additive. In other embodiments the composition contains either (C) a phosphorus compound or (D) a non-genetically modified vegetable oil.

U.S. Pat. No. 5,641,734 (Naegely, Jul. 24, 1997) describes a lubricant composition which is useful as a chain bar lubricant for chain saws. The composition comprises (A) at least one triglyceride wherein the ratio of the oleic acid moiety:linoleic acid moiety is from about 2 up to about 90, (B) at least one viscosity modifying additive, and (C) at least one tackifier.

Optionally, the composition may also contain (D) at least one pour point depressant and (E) at least one antiwear agent.

SUMMARY OF THE INVENTION

A composition, comprising;

(A) at least one triglyceride oil of the formula

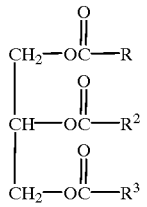

wherein $R^1$, $R^2$ and $R^3$ are aliphatic hydrocarbyl groups containing from about 7 to about 23 carbon atoms;

(B) a pour point depressant comprising (1) an alkylated polystyrene or (2) a polyalkyl methacrylate; and (C) an antioxidant comprising an amine of the formula (1)

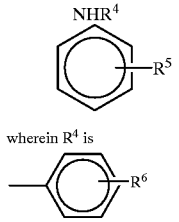

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group.

Optionally, the (A), (B) and (C) composition may further comprise (D) other oils comprising (1) a synthetic ester base oil or (2) a polyalphaolefin.

DETAILED DESCRIPTION OF THE INVENTION (A) The Triglyceride Oil

In practicing this invention, the base oil is a synthetic triglyceride or a natural oil of the formula

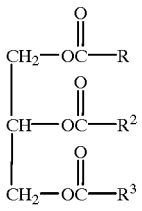

wherein $R^1$, $R^2$ and $R^3$ are aliphatic hydrocarbyl groups that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

The triglyceride oils suitable for use in this invention are the vegetable oils and modified vegetable oils. The vegetable oil triglycerides are naturally occurring oils. By "naturally occurring" it is meant that the seeds from which the oils are obtained have not been subjected to any genetic altering. Further, by "naturally occurring" it is meant that the oils obtained are not subjected to hydrogenation or any chemical treatment that alters the di-and tri-unsaturation character. The naturally occurring vegetable oils having utility in this invention comprise at least one of soybean oil, rapeseed oil, sunflower oil, coconut oil, lesquerella oil, canola oil, peanut oil, corn oil, cottonseed oil, palm oil, safflower oil, meadowfoam oil or castor oil.

The triglyceride oils may also be modified vegetable oils. Triglyceride oils are modified either chemically or genetically. Hydrogenation of naturally occurring triglycerides is the primary means of chemical modification. Naturally occurring triglyceride oils have varying fatty acid profiles. The fatty acid profile for naturally occurring sunflower oil is

| | |
|---|---|
| palmitic acid | 70 percent |
| stearic acid | 4.5 percent |
| oleic acid | 18.7 percent |
| linoleic acid | 67.5 percent |
| linolenic acid | 0.8 percent |
| other acids | 1.5 percent |

By chemically modifying sunflower oil by hydrogenation, it is meant that hydrogen is permitted to react with the unsaturated fatty acid profile present such as oleic acid, linoleic acid and linoleic acid. The object is not to remove all the unsaturation. Further, the object is not to hydrogenate such that the oleic acid profile is reduced to a stearic acid profile. The object of chemical modification via hydrogenation is to engage the linoleic acid profile and reduce or convert a substantial portion of it to an oleic acid profile. The linoleic acid profile of naturally occurring sunflower oil is 67.5 percent. It is a goal of chemical modification to hydrogenate such that the linoleic acid is reduced to about 25 percent. That means that the oleic acid profile is increased from 18.7 percent to about 61 percent (18,7 percent original oleic acid profile +42.5 percent generated oleic acid from linoleic acid).

Hydrogenation is the reaction of a vegetable oil with hydrogen gas in the presence of a catalyst. The most commonly used catalyst is a nickel catalyst. This treatment results in the addition of hydrogen to the oil, thus reducing the linoleic acid profile and linoleic acid profile. Only the unsaturated fatty acid profiles participate in the hydrogenation reaction. During hydrogenation, other reactions also occur, such as shifting of the double bonds to a new position and also twisting from the cis form to the higher melting trans form.

Table I shows the oleic acid (18:1), linoleic acid (18:2) and linoleic acid (18:3) profiles of selected naturally occurring vegetable oils. It is possible to chemically modify, via hydrogenation, a substantial portion of the linoleic acid profile of the triglyceride to increase the oleic acid profile to above 60 percent.

TABLE I

| Oil | 18:1 | 18:2 | 18:3 |
|---|---|---|---|
| Corn oil | 25.4 | 59.6 | 1.2 |
| Cottonseed oil | 18.6 | 54.4 | 0.7 |
| Peanut oil | 46.7 | 32.0 | — |
| Safflower oil | 12.0 | 77.7 | 0.4 |

TABLE I-continued

| Oil | 18:1 | 18:2 | 18:3 |
|---|---|---|---|
| Soybean oil | 23.2 | 53.7 | 7.6 |
| Sunflower oil | 18.7 | 67.5 | 0.8 |

Genetic modification occurs in the seed stock. The harvested crop then contains a triglyceride oil that when extracted has a much higher oleic acid profile and a much lower linoleic acid profile. Referring to Table I above, a naturally occurring sunflower oil has an oleic acid profile of 18.7 percent. A genetically modified sunflower oil has an oleic acid profile of 81.3 percent and linoleic acid profile of 9.0 percent. One can also genetically modify the various vegetable oils from Table I to obtain an oleic acid profile of above 90 percent. The chemically modified vegetable oils comprise at least one of a chemically modified corn oil, chemically modified cottonseed oil, chemically modified peanut oil, chemically modified palm oil chemically modified castor oil, chemically modified canola oil, chemically modified rapeseed oil, chemically modified safflower oil, chemically modified soybean oil and chemically modified sunflower oil.

In a preferred embodiment, the aliphatic hydrocarbyl groups of $R^1$ , $R^2$ and $R^3$ are such that the triglyceride has a monounsaturated character of at least 60 percent, preferably at least 70 percent and most preferably at least 80 percent. Triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ and $R^3COO^-$ to the 1,2,3-propanetriyl group $—CH_2CHCH_2$ — are the residue of an oleic acid molecule. U.S. Pat. No. 4,627,192 and U.S. Pat. No. 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil, high oleic cottonseed, high oleic lesquerella oil, high oleic palm oil, high oleic castor oil, high oleic meadowfoam oil and high oleic soybean oil. Canola oil is a variety of rapeseed oil containing less than 1 percent erucic acid. A preferred high oleic vegetable oil is high oleic sunflower oil obtained from Helianthus sp. This product is available from AC Humko, Cordova, Tenn., 38018 as TriSun™ high oleic sunflower oil. TriSun 80 is a high oleic triglyceride wherein the acid moieties comprise 80 percent oleic acid. Another preferred high oleic vegetable oil is high oleic canola oil obtained from Brassica campestris or Brassica napus, also available from AC Humko as RS high oleic oil. RS80 oil signifies a canola oil wherein the acid moieties comprise 80 percent oleic acid.

It is further to be noted that genetically modified vegetable oils have high oleic acid contents at the expense of the di-and tri-unsaturated acids. A normal sunflower oil has from 20–40 percent oleic acid moieties and from 50–70 percent linoleic acid moieties. This gives a 90 percent content of mono- and di-unsaturated acid moieties (20+70) or (40 +50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

(B) The Pour Point Depressant

There is a natural stiffening at low temperatures of vegetable oils, especially vegetable oils with a high monounsaturation content. This is analogous to the stiffening of honey or molasses at a reduced temperature. To maintain the "pour" or "flow" of a vegetable oil at reduced temperatures, it becomes necessary to add a pour point depressant.

Pour point depressants having utility in this invention are the alkylated polystyrenes and polyalkyl methacrylates.

Two different reaction routes are envisioned in preparing the alkylated polystyrenes. The first route involves reacting either an alkyl chloride or an alkene with styrene to form an alkylated styrene. The alkylated styrene is then polymerized to form an alkylated polystyrene. In the second route styrene is polymerized to form polystyrene and propylene or butylenes or mixtures thereof are polymerized to form polypropylene, polybutylenes or mixtures of polypropylenes and polybutylenes, also known as polyalkylenes. The polystyrene is then alkylated with the polyalkylenes to form the alkylated polystyrenes.

A preferred pour point depressant in the class of alkylated polystyrene is Keil-Flo™ 150, available from Ferro Corporation-Petroleum Additives, 3000 Sheffield Avenue, Hammond, Ind. 46327.

The polyalkyl methacrylates suitable for use in the present invention are prepared by the polymerization of $C_1$–$C_{30}$ methacrylates. Preparation of these polymers may further include the use of acrylic monomers having nitrogen-containing functional groups, hydroxy groups and/or alkoxy groups which provide additional properties to the polyalkyl methacrylates such as improved dispersancy. The polyalkyl methacrylates preferably have a number average molecular weight of from 10,000 to 250,000 and preferably 20,000 to 200,000. The polyalkyl methacrylates may be prepared by conventional methods of free-radical or anionic polymerization. A preferred pour point depressant in the class of polyalkyl methacrylates is EF 171 available from RohMax, USA, Delran, N.J. 08075.

(C) The Amine Antioxidant

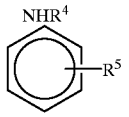

-continued wherein $R^4$ is

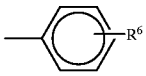

and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group.

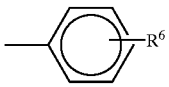

preferably $R^6$ is an alkaryl group represented by the structure

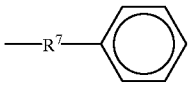

and $R^7$ is an aliphatic group that contains from 1 to 4 carbon atoms. Preferably $R^7$ contains 2 carbon atoms and is represented by the structure

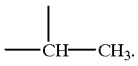

One preferred amine antioxidant is styrenated diphenylamine of the formula

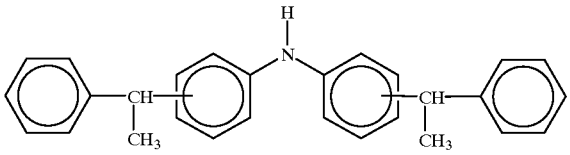

available as Wingstay® 29 from Goodyear in Akron, Ohio 44316.

In another preferred amine antioxidant, R5 is hydrogen and $R^4$ must be an aryl group.

A preferred aryl group is of the structure

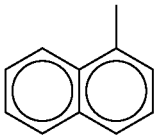

and this preferred amine antioxidant has the formula

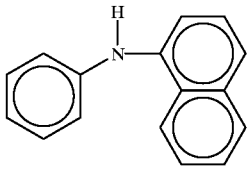

which is phenyl-α-naphthylamine (PANA).

(D) The Other Oils

The (A), (B) and (C) composition of this invention may further comprise other oils comprising (D) (1) a synthetic ester base oil, ( D) (2) a polyalphaolefin or (D) (3) unrefined, refined or redefined oils as well as mixtures of two or more of any of (D) (1), (D) (2) and (D)

(3). The synthetic ester base oil (D) (1) comprises the reaction of a monocarboxylic acid of the formula a dicarboxylic acid of the formula $R^8COOH$,

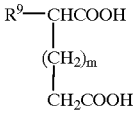

a dicarboxylic acid of the formula $R^{10}$—$Ar(COOH)_p$ wherein $R^8$ is a hydrocarbyl group containing from about 4 to about 24 carbon atoms, $R^9$ is hydrogen or a hydrocarbyl group containing from about 4 to about 50 carbon atoms, $R^{10}$ is hydrogen or a hydrocarbyl group containing from I up to about 24 carbon atoms, m is an integer of from zero to about 6 and p is an integer of from 1 to about 4; with an alcohol of the formula

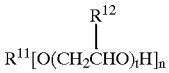

wherein $R^{11}$ is an aliphatic group containing from 1 to about 24 carbon atoms or an aromatic group containing from 6 to about 18 carbon atoms, $R^{12}$ is hydrogen or an alkyl group containing 1 or 2 carbon atoms, t is from 0 to about 40 and n is from 1 to about 6.

Within the monocarboxylic acid, $R^8$ preferably contains from about 6 to about 18 carbon atoms. An illustrative but non-exhaustive list of monocarboxylic acids are the isomeric carboxylic acids of butanoic, hexanoic, octanoic, nonanoic, decanoic, undecanoic, dodecanoic, palmitic, and stearic acids.

Within the dicarboxylic acid, $R^9$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^{10}$ preferably contains from about 6 to about 18 carbon atoms and p is 2. Aryl carboxylic acids having utility are benzoic, toluic, ethylbenzoic, phthalic, isophthalic, terephthalic, hemimellitic, trimellitic, trimeric, and pyromellitic acids.

Within the alcohols, $R^{11}$ preferably contains from about 3 to about 18 carbon atoms and t is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^{11}$ is derived include 1-octanol, 1-decanol, 1-dodecanol, 1-tetradecanol, 1-hexadecanol, 1-octadecanol, oleyl alcohol, linoleyl alcohol, linolenyl alcohol, phytol, myristyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1–10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3,propanediol (trimethylolpropane), bis-trimethylolpropane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $$CH_3(CH_2)_xCH_2(OCH_2CH_2)_nOH$$

wherein x varies between 4 and 16 and n is a number between about 3 and 11. Specific examples of ALFONIC® ethoxylates characterized by the above formula include ALFONIC® 1012–60 wherein x is about 8 to 10 and n is an average of about 5.7; ALFONIC® 1214 –70 wherein x is about 10–12 and n is an average of about 10.6; ALFONIC® 1412–60 wherein x is from 10–12 and n is an average of about 7; and ALFONIC® 1218–70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23–6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of 1 COOH per 1 OH group using esterification procedures, conditions and catalysts known in the art.

A non-exhaustive list of companies that produce synthetic esters and their trade names are BASF as Glissofluid, Ciba-Geigy as Reolube, JCI as Emkarote, Oleofina as Radialube and the Emery Group of Henkel Corporation as Emery.

The polyalphaolefins (D) (2) such as alkylene oxide polymers and interpolymers and derivative thereof where the terminal hydroxyl groups have been modified by esterification, etherification, etc., constitute another class of oils that can be used. These are exemplified by the oils prepared through polymerization of ethylene oxide or propylene oxide, the alkyl and aryl ethers of these polyoxyalkylene polymers (e.g., methylpolyisopropylene glycolether having an average molecule weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethyleneglycol.

The unrefined, refined and redefined oils, (D) (3), as well as mixtures of two or more of any of these can be used in the lubricant composition of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Redefined oils are obtained by processes similar to those used to obtain refined oils applied to refined oils which have been already used in service. Such redefined oils are also known as reclaimed or reprocessed oils and often are additionally processed by techniques for removal of spent additives and oil breakdown products.

The compositions of the present invention comprising components (A), (B) and (C) or (A), (B), (C) and (D) are useful as biodegradable lubricants.

When the composition comprises components (A), (B) and (C), the following states the ranges of these components in parts by weight.

| Component | Generally | Preferred | Most Preferred |
|---|---|---|---|
| (A) | 50–99 | 65–99 | 90–99 |
| (B) | 0.1–5 | 0.5–4 | 0.75–3 |
| (C) | 0.1–5 | 0.1–3 | 0.1–2 |

When the composition comprises components (A), (B), (C) and (D), the following states the ranges of these components in parts by weight.

| Component | Generally | Preferred | Most Preferred |
|---|---|---|---|
| (A) | 40–90 | 40–80 | 45–75 |
| (B) | 0.1–5 | 0.5–4 | 0.75–3 |
| (C) | 0.1–5 | 0.1–3 | 0.1–2 |
| (D) | 1–80 | 10–60 | 25–50 |

It is understood that other components besides (A), (B), (C) and (D) may be present within the composition of this invention.

The components of this invention are blended together according to the above ranges to effect solution. Order of addition is of no consequence, although typically (B) and (C) or (B), (C) and (D) are added to (A).

Table II is a comparison of the rotary bomb oxidation test (RBOT) (ASTM D2272). In Table II, Examples 1 and 2 are baselines of 100 percent vegetable oil compositions. The remaining examples contain other additives in varying amounts. Examples 5–7 are directed to the instant invention and the remaining examples, which are not part of the invention, can be compared to Examples 5–7. In three instances the non-inventive examples (11–13) compare favorably to Examples 5–7. This is due to the fact that Examples 11 and 13 utilize components of the instant invention and Example 12 is a mineral oil formulation and not a vegetable oil formulation. An improvement is noted in the RBOT on the filly formulated inventive examples. All parts are by weight.

TABLE II

| | COMPONENTS | | | | |
|---|---|---|---|---|---|
| EXAMPLE | (A) | (B) | (C) | (D) | RBOT |
| 1. | 100 Parts TriSun 90 | None | None | None | 16 |
| 2. | 100 parts RS 80 | None | None | None | 14 |
| 3. | 98.0 parts TriSun 90 + 2.0 parts a | None | None | None | 131 |
| 4. | 98.0 parts TriSun 90 + 2.0 parts b | None | None | None | 138 |
| 5. | 28.66 parts TriSun 90 + 28.66 parts RS 80 | 1.28 parts Keil Flo 150 | 0.3 parts Wingstay 29 0.3 parts PANA | 20.04 parts PAO 20.04 parts syn ester | 261 |
| 6. | 33.73 parts TriSun 90 33.73 parts RS 80 | 1.52 parts Keil Flo 150 | 0.35 parts Wingstay 29 0.35 parts PANA | 15.16 parts PAO 15.16 parts syn ester | 273 |
| 7. | 67.08 parts TriSun 90 | 2.03 parts Keil Flo 150 | 0.20 parts Wingstay 29 0.20 parts PANA | 15.25 parts PAO 15.25 parts syn ester | 402 |
| 8. | 98.75 parts TriSun 90 + 1.25 parts c | None | None | None | 147 |
| 9. | 67.2 parts TriSun 90 + 4.0 parts d | None | None | 28.8 parts syn ester | 197 |
| 10. | 96.0 parts RS 80 + 4.0 parts d | None | None | None | 139 |
| 11. | 98.27 parts TriSun 90 + 1.0 parts c | None | 0.365 parts Wingstay 29 0.365 parts PANA | None | 276 |
| 12. | 98.75 parts mineral oil + 1.25 parts c | None | None | None | 262 |
| 13. | 48.17 parts RS 80 + 1.25 parts c | 2.0 parts Keil Flo 150 | 0.205 parts Wingstay 29 0.205 parts PANA | 48.17 parts rerefined oil | 237 |
| 14. | 99 parts TriSun 90 + 1.0 part e | None | None | None | 97 |
| 15. | 98.15 parts TriSun 90 + 0.65 parts f; 0.35 parts g, 0.85 parts h | None | None | None | 104 |
| 16. | 97.8 parts TriSun 90 + 1.4 parts f; 0.8 parts g, | None | None | None | 61 |
| 17. | 98.15 parts TriSun 90 + 0.2 parts i, 0.4 parts j, 1.25 parts c | None | None | None | 94 |
| 18. | 98.0 parts TriSun 90 + 1.0 parts b, 1.0 part g, | None | None | None | 110 |
| 19. | 98.15 parts TriSun 90 + 0.65 parts f, 0.35 parts g, 0.85 parts h | None | None | None | 104 |
| 20 | 98.6 parts TriSun 90 + 0.5 parts j, 0.9 parts k, | None | None | None | 108 |
| 21 | 98.65 parts TriSun 90 + 0.9 parts j, 0.32 parts k, | None | None | None | 115 |
| 22 | 98.15 parts TriSun 90 + 0.3 parts j, 0.3 parts k, 1.25 parts c | None | None | None | 149 |
| 23 | 98.15 parts TriSun 90 + 0.3 parts j, 0.3 parts l, 1.25 parts c | None | None | None | 128 |

a: 2,6-di-t-butylphenol b: an ashless phenolic antioxidant c: a complete hydraulic package that contains antiwear agents and antioxidants available from The Lubrizol Corp as LZ 5186B TABLE II-continued

| | COMPONENTS | | | | |
|---|---|---|---|---|---|
| EXAMPLE | (A) | (B) | (C) | (D) | RBOT |

d: a complete commercial hydraulic package that contains antiwear agent and antioxidants and pour point depressants available from The Lubrizol Corp as LZ 7653
e: a commercial rust and antioxidant composition available from Rhein Chemie as Additin ® RC 9308
f: an alkylated diphenylamine
g: butylated hydroxytoluene
h: an antiwear/antioxidant of an organic chemical additive containing phosphorus and sulfur
i: a dithiocarbamate
j: tolyltriazole
k: liquid phenolic antioxidant available from Ciba Geigy as Irganox L 135
l: butylated reaction product of p-cresol and dicyclopentadiene Table III is directed to the Mini-Rotary Viscometer (MRV) (ASTM D4684). The MRV is a low shear rate measurement. Slow sample cooling rate is the key feature of this instrument. A sample is preheated to have a specified thermal history which includes warming, slow cooling and soaking cycles. The MRV measures an apparent yield stress, which is the minimum stress needed to cause oil to flow. It also measures an apparent viscosity under shear rates of 1 to 50 $s^{1}$. This procedure was developed to predict low temperature pumpability of motor oils in field service.

To measure the cold temperature performance, the compositions of this invention are evaluated at several different temperatures. When the evaluation temperature is, for example, —25° C., a 15 winter grade specification is denoted. The following temperatures denote a corresponding viscosity grade.

| | |
|---|---|
| −40° C. | 0 W |
| −35 | 5 |
| −30 | 10 |
| −25 | 15 |
| −20 | 20 |
| −15 | 25 |

At whatever temperature the composition is evaluated, the viscosity measurement must be less than 60,000 centipoise (cP) to give a pass result and the lower the cP, the better. The MRV is a more severe evaluation than the standard pour point procedure of (ASTM D97).

Within Table III, Examples 1 and 2 are baselines of 100 percent vegetable oil compositions. At —25° C., Examples 1 and 2 are too viscous to measure (TVTM) and as such are considered a fail result. The remaining examples contain other additives in varying amounts. Examples 3–6 are vegetable oil compositions that contain pour point depressants and these pour point depressants are not part of the instant invention. Example 3–6 all are too viscous to measure and give a fail result. Examples 7–13 are vegetable oil compositions that contain the pour point depressants of the instant invention. Not only do Examples 7–13 show a pass result in the MRV, but the viscosity measurement is well below 60,000 cP, the pass/fail point.

TABLE III

| | COMPONENTS | | | | | |
|---|---|---|---|---|---|---|
| EXAMPLE | (A) | (B) | (C) | (D) | cP | ° C. |
| 1. | 100 Parts TriSun 90 | None | None | None | TVTM* | −15 |
| 2. | 100 parts RS 80 | None | None | None | TVTM | −20 |
| 3. | 98.0 parts RS 80 + 2.0 parts m | | None | None | TVTM | −25 |
| 4. | 34 parts TriSun 90 34 parts RS 80 + 2 parts n | None | None | 30 parts syn ester | TVTM | −30 |
| 5. | 34 parts TriSun 90 34 parts RS 80 + 2 parts m | None | None | 30 parts syn ester | TVTM | −25 |
| 6. | 68 parts TriSun 90 + 2 parts n | None | None | 30 parts syn ester | TVTM | −25 |
| 7. | 98 parts RS 80 | 2 parts Keil Flo 150 | None | None | 1864 | −25 |
| 8. | 68 parts high oleic soybean oil | 2 parts Keil Flo 150 | None | 30 parts syn ester | 9089 | −30 |
| 9. | 68 parts TriSun 90 | 2 parts Keil Flo 150 | None | 30 parts syn ester | 1861 | −25 |
| 10. | 68 parts TriSun 90 | 2 parts RohMax 10–310 | None | 30 parts syn ester | 1948 2730 | −25 −30 |
| 11. | 34 parts TriSun 90 34 parts RS 80 | 2 parts Keil Flo 150 | None | 30 parts syn ester | 1531 2687 | −25 −30 |
| 12. | 34 parts TriSun 90 34 parts RS 80 | 2 parts RohMax 10–310 | None | 30 parts syn ester | 1576 2581 | −25 −30 |
| 13. | 98 parts RS 80 | 2 parts RohMax 10–310 | None | None | 1791 3438 | −25 −30 |

TABLE III-continued

| | COMPONENTS | | | | | |
|---|---|---|---|---|---|---|
| EXAMPLE | (A) | (B) | (C) | (D) | cP | ° C. |

*too viscous to measure
m ester of a maleic anhydride-styrene copolymer in mineral oil available from The Lubrizol Corp as LZ 6662
n ester of a maleic anhydride-styrene copolymer in mineral oil available from The Lubrizol Corp as LZ 7671

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition, comprising;

(B) at least one triglyceride oil of the formula

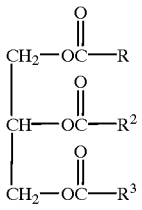

wherein $R^1$, $R^2$ and $R^3$ are aliphatic hydrocarbyl groups containing from about 7 to about 23 carbon atoms;

(B) a pour point depressant comprising (1) an alkylated polystyrene and (C) an antioxidant comprising an amine of the formula

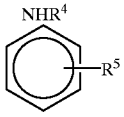

wherein $R^4$ is

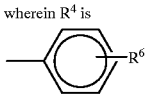

wherein $R^4$ is and $R^5$ is hydrogen, an alkaryl group or an aralkyl group, $R^6$ is an aryl group, an alkaryl group or an aralkyl group, with the proviso that when $R^5$ is hydrogen, then $R^4$ is an aryl group.

2. The composition of claim 1 wherein within (A), the triglyceride oil is a naturally occurring vegetable oil.

3. The composition of claim 1 wherein within (A), the triglyceride oil is a modified vegetable oil.

4. The composition of claim 2 wherein the naturally occurring vegetable oil comprises at least one of soybean oil, rapeseed oil, sunflower oil, coconut oil lesquerella oil, canola oil, peanut oil, corn oil, cottonseed oil, palm oil safflower oil, meadowfoam oil or castor oil.

5. The composition of claim 3 wherein the modified vegetable oil is a chemically modified vegetable oil or a genetically modified vegetable oil.

6. The composition of claim 5 wherein $R^1$, $R^2$ and $R^3$ have at least a 60 percent monounsaturation content derived from an oleic acid residue.

7. The composition of claim 6 wherein the chemically modified vegetable oil comprises at least one of a chemically modified corn oil, chemically modified cottonseed oil, chemically modified peanut oil, chemically modified palm oil, chemically modified castor oil, chemically modified canola oil, chemically modified rapeseed oil, chemically modified safflower oil, chemically modified soybean oil and chemically modified sunflower oil.

8. The composition of claim 6 wherein the genetically modified vegetable oil comprises at least one of a genetically modified safflower oil, genetically modified canola oil, genetically modified peanut oil, genetically modified corn oil, genetically modified rapeseed oil, genetically modified sunflower oil, genetically modified cottonseed, genetically modified lesquerella oil, genetically modified palm oil, genetically modified castor oil, genetically modified meadowfoam oil or genetically modified soybean oil.

9. The composition of claim 1 wherein within (C), $R^5$ and $R^6$ are alkaryl groups wherein the alkaryl group is

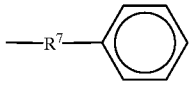

and $R^7$ is an aliphatic group that contains from 1 to 4 carbon atoms.

10. The composition of claim 10 wherein $R^7$ contains 2 carbon atoms.

11. The composition of claim 9 wherein $R^7$ is

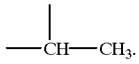

12. The composition of claim 1 wherein within (C), $R^5$ is hydrogen and $R^4$ is an alpha naphthyl group.

13. The composition of claim 1 further comprising (D) other oils comprising (1) a synthetic ester base oil or (2) a polyalphaolefin.

14. The composition of claim 13 the synthetic ester base oil comprises the reaction of a monocarboxylic acid of the formula $R^8COOH$ or a dicarboxylic acid of the formula

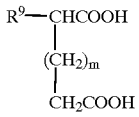

or an aryl carboxylic acid of the formula

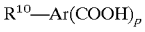

wherein $R^8$ is a hydrocarbyl group containing from about 4 to about 24 carbon atoms, $R^9$ is hydrogen or a hydrocarbyl group containing from about 4 to about 50 carbon atoms, $R^{10}$ is hydrogen or a hydrocarbyl group containing from 1 up to about 24 carbon atoms, m is an integer of from zero to about 6 and p is an integer of from 1 to about 4; with an alcohol of the formula

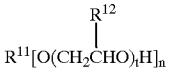

wherein $R^{11}$ is an aliphatic group containing from 1 to about 24 carbon atoms or an aromatic group containing from 6 to about 18 carbon atoms, $R^{12}$ is hydrogen or an alkyl group containing 1 or 2 carbon atoms, t is from 0 to about 40 and n is from 1 to about 6.

15. The composition of claim 14 wherein $R^8$ contains from about 6 to about 18 carbon atoms.

16. The composition of claim 14 wherein $R^9$ contains from about 4 to about 24 carbon atoms and m is zero.

17. The composition of claim 14 wherein $R^9$ is hydrogen and m is 4.

18. The composition of claim 14 wherein $R^{10}$ contains from about 6 to about 18 carbon atoms and p is 2.

19. The composition of claim 14 wherein $R^{11}$ contains from about 3 to about 1 8 carbon atoms.

* * * * *